United States Patent [19]

Stevenson, IV

[11] Patent Number: 4,881,480

[45] Date of Patent: Nov. 21, 1989

[54] MARINE SAIL WITH BATTENS

[76] Inventor: William H. Stevenson, IV, P.O. Box U, St. Michaels, Md. 21663

[21] Appl. No.: 162,198

[22] Filed: Feb. 29, 1988

Related U.S. Application Data

[63] Continuation-in-part of Ser. No. 105,742, Oct. 8, 1987, Pat. No. 4,838,192.

[51] Int. Cl.[4] ..... B63H 9/04

[52] U.S. Cl. ..... 114/103

[58] Field of Search ..... 114/102, 103, 104, 105

[56] References Cited

U.S. PATENT DOCUMENTS

| | | | |
|---|---|---|---|
| 4,305 | 12/1845 | Maull . | |
| 287,465 | 10/1883 | Pinkham . | |
| 522,524 | 7/1894 | Hook | 114/101 |
| 758,171 | 4/1904 | Collins . | |
| 855,238 | 5/1907 | Ericson | 114/105 |
| 2,077,685 | 4/1937 | Gerhardt | 114/103 |
| 2,620,760 | 12/1952 | Melges | 114/103 |
| 3,084,656 | 4/1963 | Johnson | 114/105 |
| 3,557,733 | 1/1971 | Mathieu et al. | 114/102 |
| 4,343,257 | 8/1982 | Stevenson, IV | 114/104 |
| 4,365,572 | 12/1982 | Stevenson, IV | 114/104 |
| 4,503,796 | 3/1985 | Bierig | 114/89 |
| 4,535,825 | 8/1985 | Hackney | 114/103 |
| 4,633,798 | 1/1987 | Skinner et al. | 114/107 |
| 4,686,921 | 8/1987 | Magnan | 114/102 |
| 4,699,073 | 10/1987 | Farneti | 114/102 |
| 4,706,591 | 11/1987 | Reynolds | 114/103 |

*Primary Examiner*—Sherman D. Basinger

*Attorney, Agent, or Firm*—Roylance, Abrams, Berdo & Goodman

[57] ABSTRACT

A marine sail having a moveable batten that can be shifted between an operative position when the sail is at least partially unfurled and a stowed position before or while the sail is being furled. In the stowed position, the batten is at least generally parallel to an edge of the sail. The batten is advantageously flexible and is supported in at least one pocket coupled to the sail. The batten is moved between the operative and stowed positions by a line and a pair of sheaves.

14 Claims, 1 Drawing Sheet

MARINE SAIL WITH BATTENS

This invention relates to marine sails, including foresails and mainsails, which are furled toward the luff and include a batten or battens. This application is a continuation-in-part of copending application Ser. No. 105,742, filed Oct. 8, 1987 by William H. Stevenson IV, William H. Stevenson III and Aulby B. Bates III and now patent No. 4,838,192.

BACKGROUND OF THE INVENTION

It has long been common practice to furl marine sails from leech to luff. Such furling is relatively simple when the sail is not equipped with battens and can be accomplished, for example, in accordance with my U.S. Pat. Nos. 4,343,257 and 4,365,572. However, furling is more difficult when the sail has at least one batten, in which case the batten or battens must be removed before furling or the practices of my copending application Ser. No. 105,742 can be followed. When the sail is a genoa, which overlaps the mast, battens have not been employed because the batten impacts the mast when tacking or jibing. There has been a continuing need for improvement.

SUMMARY OF THE INVENTION

Considered broadly, sails according to the invention include means for holding the batten in an operative position relative to the sail body when the sail is at least partially unfurled and means for moving the batten relative to the sail body to a position in which the batten extends generally parallel to the luff when the sail is being furled. In particularly advantageous embodiments, the batten extends across the sail from leech toward the luff when the sail is unfurled and is retained in that position by a pocket secured to the sail, and the forward end of the pocket curves upwardly into general parallelism with the luff. Operating means, advantageously in the form of a line extending over upper and lower sheaves secured to the sail and attached to the forward end portion of the batten, is provided in such fashion as to be selectively manipulatable to withdraw the batten from the pocket and move into its upright position, as the sail is being furled, and to push the batten back into the pocket, as the sail is unfurled. Advantageously, a second pocket is provided to accommodate both the batten and the operating means when the sail is furled. The invention provides a novel genoa in which at least one batten extends forwardly from the leech, the arrangement being such that the genoa can pass the mast during tacking or jibing.

IDENTIFICATION OF THE DRAWINGS

FIG. 1 is a semidiagrammatic elevational view of a headsail, unfurled and flying, according to one embodiment of the invention;

FIGS. 2 and 3 are transverse cross-sectional views taken generally on lines 2—2 and 3—3, FIG. 1, respectively;

FIG. 4 is an enlarged view, partly in axial cross section and partly in side elevational, of the forward end of the batten of the sail shown in FIG. 1; and FIG. 5 is a transverse cross-sectional view of one modified form of the batten.

DETAILED DESCRIPTION OF THE INVENTION

Figure 1:
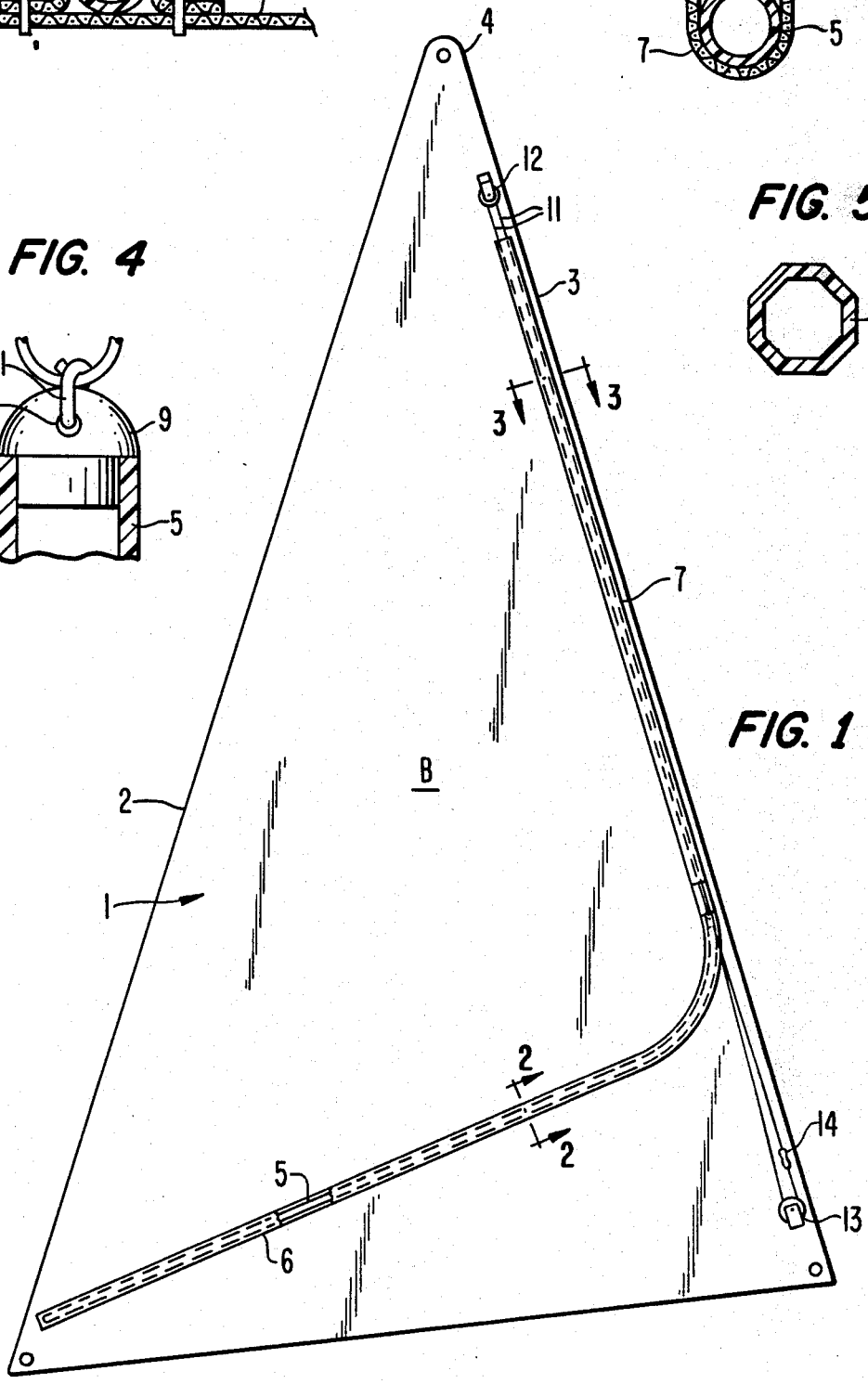

In the drawings, the invention is illustrated as applied to a genoa indicated generally at 1 and having a leech 2, a luff 3 and a head 4. The sail is equipped with an elongated batten 5 which, when in the operative position shown in FIG. 1, is slidably accommodated by a first pocket 6 extending from the leech, or first edge, toward the luff, or second edge. The forward end portion of pocket 6 is arcuate, curving upwardly to communicate with a second pocket 7 which extends along, and is therefore generally parallel to, the luff of the sail. Considering FIGS. 1 and 3, it will be seen that body B of the sail is generally triangular and the luff is in the form of a conventional luff tape 8. Pocket 6 is formed by stitching the edges of a strip of sail cloth or other suitable flexible sheet material directly to the sail body, the two lines of stitching being sufficiently close to each other to cause the material to have a transverse cross section adequate to slidably embrace the batten. Pocket 7 is formed in the same fashion as pocket 6 but is secured to one side of luff tape 8.

Figure 2:
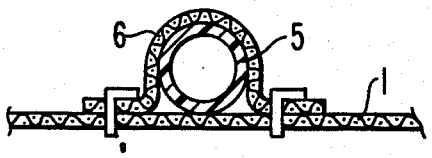
Figure 3:
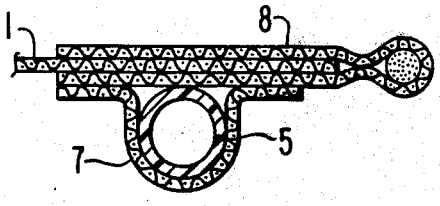
Figure 4:
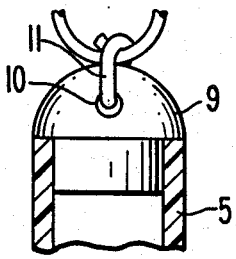
Figure 5:
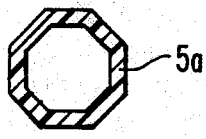

Batten 5 is advantageously in the form of an elongated tube of polymeric material, such as polyvinyl chloride, having adequate stiffness to serve its purpose as a batten but being adequately flexible to traverse the arcuate forward end portion of pocket 6. The batten can be of circular transverse cross section, as seen in FIGS. 2–4, though any other suitable cross-sectional shape can be used, such as the polygonal shape of batten 5*a*, FIG. 5. The forward end of batten 5 is closed by a rounded nose member 9 which is rigidly secured to the tubular end of the batten in any suitable manner and has a transverse bore 10 to accommodate an operating line 11 which is tied to the nose member. The outer surface of batten 5 is a low-friction surface and, with pockets 6 and 7 embracing the batten only loosely, the batten can be moved lengthwise through the pockets with relative ease.

Movement of the batten relative to the sail is accomplished by manual manipulation of operating means comprising line 11. The operating line extends upwardly through pocket 7, over a conventional upper block or sheave 12 secured to the sail, thence downwardly through pocket 7 and around a second conventional block or sheave 13 secured to the sail near the clew. A conventional jam cleat 14 is provided so that the operating line, and therefore batten 5, can be secured in any selected position.

When sail 1 is completely unfurled and flying, batten 5 occupies the position shown in FIG. 1, with the forward end position of the batten extending through an arcuate forward end portion of pocket 6 and being secured to one run of line 11 in pocket 7. When the sail is furled from leech to luff, line 11 is manipulated to pull the batten out of pocket 6 into pocket 7 and the operating line is secured at cleat 14. When the sail is to be unfurled, line 11 is moved in the opposite direction to pull the batten downwardly from pocket 7. With the lower end of pocket 7 closed against passage of the batten, manipulation of line 11 to pull the batten downwardly causes the batten to be pushed into and through the arcuate forward end portion of pocket 6 and the batten is thus returned to the operative position seen in FIG. 1.

When the sail is a genoa and equipped with a batten of adequate flexibility to traverse the arcuate forward portion of pocket 6, the sail can pass from one side of the mast to the other, as in tacking or jibing, because the batten is adequately flexible to be simply deflected as the batten engages the mast.

While the invention has been illustrated and described as applied to a genoa having a single batten, it will be apparent that the sail may have more than one batten, with some or all of the battens arranged as described with reference to batten 5. It will also be apparent that pocket 7 may be replaced by a double luff when the furling system of my U.S. Pat. No. 4,343,257 is employed. Further, pocket 7 can simply be eliminated, with the batten and the operating line then being in the open when the batten is in its position generally parallel to the luff.

What is claimed is:

1. A marine sail comprising, in combination:

a sail body having a leech and a forward edge spaced forwardly of the leech;

an elongated batten;

means for holding the batten in an operative position relative to the sail body when the sail is at least partially unfurled; and means for slidably moving the batten generally along its axis relative to the sail body to a position in which the batten is at least generally parallel to the forward edge of the sail body when the sail is being furled, the batten having adequate stiffness in its operative position to stiffen the sail body along the batten.

2. A sail according to claim 1, wherein the batten has a trailing end portion and a forward end portion and extends generally from the leech toward the forward edge of the sail body when the sail is unfurled; and the means for holding the batten in an operative position comprises an elongated pocket secured to the sail body and extending from the leech toward the luff of the sail.

3. A marine sail comprising, in combination:

a sail body having a leech and a forward edge spaced forwardly of the leech;

an elongated batten having a trailing end portion and a forward end portion and that extends generally from the leech toward the forward edge of the sail body when the sail is unfurled;

means for holding the batten in an operative position relative to the sail body when the sail is at least partially unfurled, the means for holding the sail body in an operative position comprising an elongated pocket secured to the sail body and extending from the leech toward the forward edge of the sail body, said pocket having a forward end that curves upwardly to be generally parallel to the forward edge of the sail body; and means for moving the batten relative to the sail body to a position in which the batten is at least generally parallel to the forward edge of the sail body when the sail is being furled.

4. A sail according to claim 3, wherein the batten is in the form of an elongated tube of polymeric material of sufficient flexibility to allow the batten to traverse the curved portion of the pocket as the batten is moved forwardly from the pocket and pushed back into the pocket.

5. A sail according to claim 3, wherein the means for moving the batten relative to the sail comprises an upper sheave secured to an upper portion of the sail body, a lower sheave secured to the sail body below the curved portion of the pocket, and a line extending over said sheaves and operatively connected to the forward end of the batten.

6. A sail according to claim 5 and further comprising means secured to the sail between the curved portion of the pocket and the lower one of the sheaves for securing the line to the sail when the line has been operated to withdraw the batten from the pocket.

7. A sail according to claim 5 and further comprising means forming an additional pocket which extends parallel to the forward edge of the sail body for accommodating the batten, the line extending through said additional pocket.

8. A marine sail comprising, in combination:

a sail body having a first edge and a second edge spaced from the first edge;

an elongated batten;

means for holding the batten in an operative position relative to the sail body when the sail is at least partially unfurled; and means for slidably moving the batten generally along its axis relative to the sail body to a position in which the batten is at least generally parallel to the second edge of the sail body, the batten having adequate stiffness in its operative position to stiffen the sail body along the batten.

9. A marine sail comprising, in combination:

A sail body having a first edge and a second edge spaced from the first edge;

an elongated batten;

means for holding the batten in an operative position relative to the sail body when the sail is at least partially unfurled; and means for slidably moving the batten generally along its axis relative to the sail body to a position in which the batten is at least generally parallel to the second edge of the sail body when the sail is being furled, the batten having adequate stiffness in its operative position to stiffen the sail body along the batten.

10. A marine sail comprising, in combination:

a sail body having a first edge and a second edge spaced from the first edge;

an elongated batten;

pocket means for holding the batten alternately between operative and inoperative positions relative to the sail body; and means for moving the batten in the pocket means relative to the sail body between the operative and inoperative positions in which the batten is held by the pocket means at least generally parallel to the second edge of the sail body when in the inoperative position, and the batten extends generally in the pocket means between the first edge and the second edge when in the operative position and when the sail is at least partially unfurled.

11. A marine sail according to claim 10, wherein the pocket means comprises a first pocket extending between the first edge of the sail body and the second edge of the sail body, and a second pocket extending at least generally parallel to the second edge of the sail body.

12. A marine sail according to claim 11, wherein said batten is flexible.

13. A marine sail comprising, in combination:

a sail body having a first edge and a second edge spaced from the first edge;

an elongated batten;

means for holding the batten in an operative position relative to the sail body when the sail is at least partially unfurled; and means for slidably moving all parts of the batten generally along its axis relative to the sail body to a position in which the batten is at least generally parallel to the second edge of the sail body, the batten having adequate stiffness in its operative position to stiffen the sail body along the batten.

14. A marine sail comprising, in combination:

a sail body having a first edge and a second edge spaced from the first edge;

an elongated batten;

means for holding the batten in an operative position relative to the sail body and wholly on one side of the sail body when the sail is at least partially unfurled; and means for slidably moving the batten generally along its axis relative to the sail body to a position in which the batten is at least generally parallel to the second edge of the sail body.

* * * * *